US005289626A

United States Patent [19]

Mochida et al.

[11] Patent Number: 5,289,626

[45] Date of Patent: Mar. 1, 1994

[54] FOUNDATION ANCHOR AND METHOD FOR SECURING SAME TO A FOUNDATION

[75] Inventors: Satoru Mochida; Akemi Nojiri, both of Tokyo, Japan

[73] Assignee: Kajima Corporation, Tokyo, Japan

[21] Appl. No.: 995,676

[22] Filed: Dec. 21, 1992

Related U.S. Application Data

[63] Continuation-in-part of Ser. No. 498,216, Mar. 23, 1990, abandoned.

[30] Foreign Application Priority Data

Mar. 27, 1989 [JP] Japan ..... 1-74284

[51] Int. Cl.[5] ..... B23P 11/00; E21D 20/00; E21D 21/00

[52] U.S. Cl. ..... 29/452; 52/223.13; 52/223.14; 405/259.1; 405/259.5

[58] Field of Search ..... 29/446, 452; 405/259.1, 405/259.5, 272, 288; 52/223.1, 223.13, 223.14

[56] References Cited

U.S. PATENT DOCUMENTS 3,647,184 3/1972 Vanderhurst et al. ..... 29/452 X
3,844,023 10/1974 Surribas et al. ..... 29/452
4,012,826 3/1977 Stansfield ..... 29/525.1 X
4,130,926 12/1978 Willem ..... 29/452 X
4,640,068 2/1987 Jungwirth et al. ..... 52/223.13
4,862,576 9/1989 Lu ..... 29/452

FOREIGN PATENT DOCUMENTS 0053955 6/1982 European Pat. Off. .

*Primary Examiner*—Mark Rosenbaum
*Assistant Examiner*—S. Thomas Hughes
*Attorney, Agent, or Firm*—James H. Tilberry

[57] ABSTRACT

A method and apparatus for securing a foundation anchor to a foundation wall. Tension members comprising the foundation anchor are individually fixed to a plurality of stacked anchor plates positioned over an access hole in a foundation wall by use of threaded fasteners. The method comprises inserting each tension member through an anchor plate hole and separately fixing each tension member to at least one anchor plate. A plurality of tension members are permitted to be threaded with threaded fasteners in a manner calculated to reduce the bearing load exerted on the threaded fasteners. Further, by selectively staggering the threaded fasteners over a plurality of stacked anchor plates, the surface area of the anchor plates can be reduced to a minimum, thereby permitting a proportionate reduction in the size of the foundation wall access hole.

7 Claims, 6 Drawing Sheets

FOUNDATION ANCHOR AND METHOD FOR SECURING SAME TO A FOUNDATION

This is a continuation-in-part of Ser. No. 7/498,216, filed Mar. 23, 1990, now abandoned.

BACKGROUND OF THE INVENTION

1. Field of the Invention

This invention relates to apparatus and methods for securing foundation anchors to foundations. More particularly, this invention relates to foundation anchors which are embedded in the ground for the purpose of resisting earth pressure and hydraulic pressure acting on concrete structures, and resisting the floating-up tendency of structures due to the buoyancy effect of underground water.

2. Description of the Prior Art

Prior art foundation anchors are known which comprise elongated steel rods, bars, strands, and/or wire, either separately or in bundles. These anchors are used to resist pressures to which concrete foundations are normally subjected, such as the lateral thrust of earthen backfill and hydraulic pressures. Hydraulic pressures may be either lateral, against the foundation side wall, or buoyantly vertical, caused by water beneath the foundation.

The anchors are customarily anchored in the earth by some form of deadman, sometimes secured in a bed of grout. Various conventional means are known for fastening and tensioning anchors to foundation walls. These means are divided broadly into two groups consisting of wedge fasteners and threaded fasteners. This invention is solely concerned with anchors in the threaded fastener group. Threaded fasteners are advantageous over wedges in that threaded fasteners are more reliably secured and are less likely to permit a loss of tension in the anchor.

A threaded fastener comprising a threaded shank on the rod, bar, or strand anchor tension member and a nut threaded on the shank is usually employed in conjunction with a bearing plate on the side of the foundation wall opposite the anchor. A hole in the foundation and in the bearing plate permits the threaded shank of the anchor tension member to pass through the foundation wall. A nut is then threaded onto the shank and brought into pressure engagement with the bearing plate, which pressure also tensions the anchor tension member.

The disadvantage of the threaded fastener type anchor tension member is that the surface area on the bearing plate required to turn the nut severely limits the number of nuts that can be accommodated on a bearing plate without resorting to a bearing plate which is impractically excessive in area. In the alternative, to bridle a plurality of anchor tension members to a single threaded shank tends to overload and thereby strip the threads of the nut, thus losing the tension in the bridled tension members. As a consequence, when a plurality of tension members are fastened to one bearing plate, the wedge securing and fastening system is the apparatus and method most commonly used.

SUMMARY OF THE INVENTION

According to a preferred embodiment of the present invention, within the foundation surface area occupied by a prior art anchor bearing plate, twice as many tension members can be secured with threaded fasteners than was heretofore possible. This is accomplished by stacking the equivalent of a pair of bearing plates, for purposes of distinction called "anchor plates," which may be supported by a bearing plate interposed between the anchor plates and a foundation wall. The anchor plates are positioned over an anchor receiving hole in the foundation wall. The anchor plates have concentrically aligned matching holes corresponding to the number of tension members which comprise the foundation anchor. A first anchor plate is positioned on the outer surface of the bearing plate. The threaded ends of the tension members, which may be steel rods, bars, wires, strands, or the like, are then passed through the foundation anchor receiving hole and through the matching holes in the first anchor plate for tensioning. Tensioning may be accomplished by several means. In the preferred embodiments of the invention, the tensioning is accomplished by first running a nut down the threaded ends of half of the tension members into pressure engagement with a first anchor plate. The tension members may then be stressed further by power means, such as a hydraulic or mechanical jack, and the tension thus set up in each of the tension members is locked in place by further threading each nut into pressure engagement with the top surface of the first anchor plate.

The second anchor plate is then placed over the threaded ends of the tension members and positioned on the top faces of the nuts in pressure engagement with the first anchor plate. Nuts are next threaded onto the remaining unstressed tension members until pressure engagement is made with the top surface of the second anchor plate. These remaining tension members are then stressed and secured in the same manner as the first tensioned members. By staggering the placement of the nuts on the threaded ends of the tension members to every other tension member on both anchor plates, more nuts can be positioned within the projected area of the foundation wall than was heretofore possible on prior art bearing plates with prior art methods.

OBJECTS OF THE INVENTION

It is among the objects of the invention to provide threaded fastener type foundation anchors which do not have the above-discussed disadvantages of prior art threaded fastener type foundation anchors. Specifically, it is an object of the invention to provide a threaded fastener type foundation anchor in which the number of nuts that can be accommodated on the surface of a bearing plate is considerably increased. It is another object of the invention to provide a threaded fastener type foundation anchor that is easier to assemble and to disassemble, and is easier to tension than prior art threaded fastener type foundation anchors.

The foregoing and other objects, features, and advantages of the invention will become apparent from the description set forth hereinafter when considered in conjunction with the accompanying drawings.

DETAILED DESCRIPTION OF THE PREFERRED EMBODIMENTS

Figure 1:
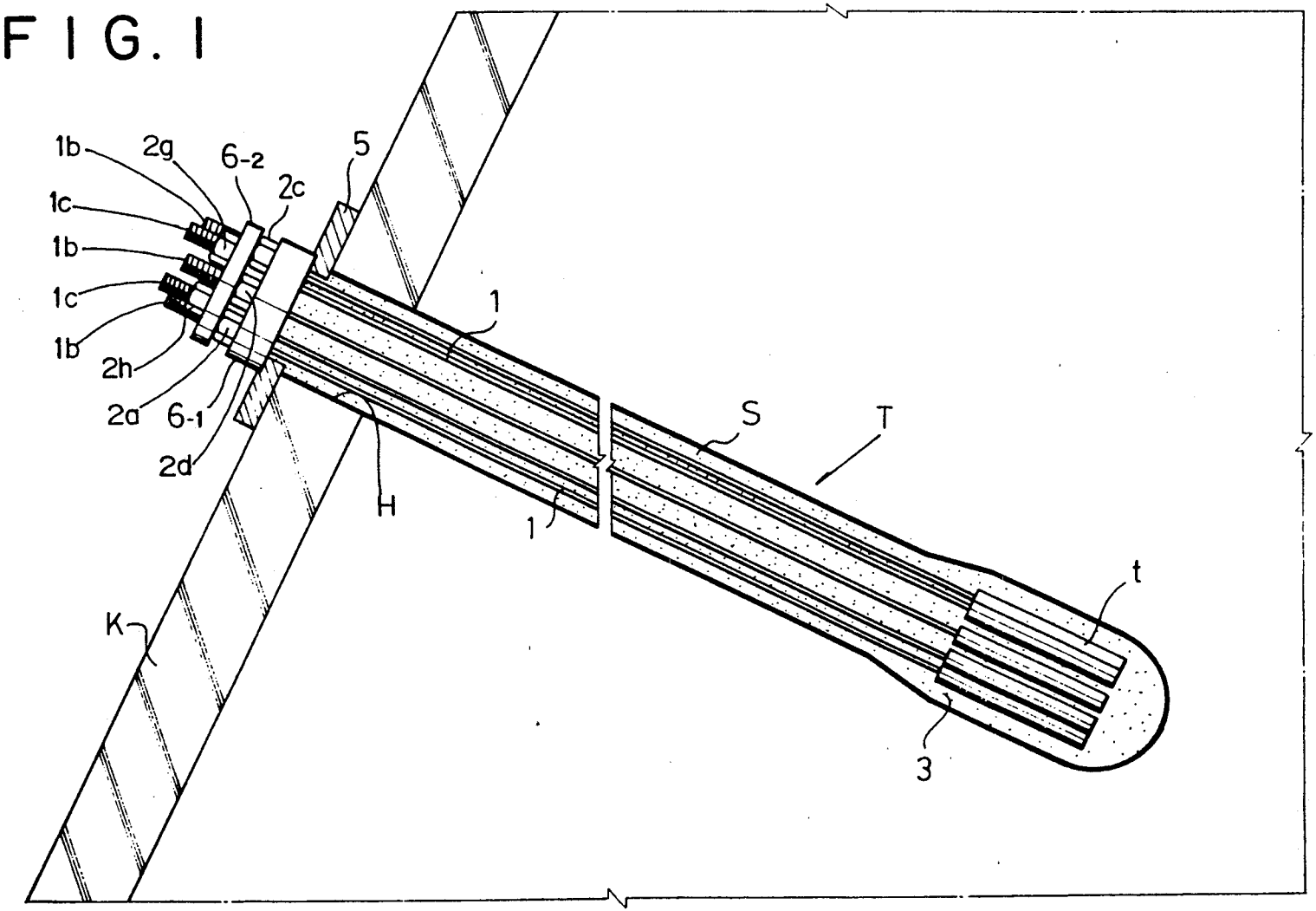
FIG. 1 is a partially sectioned side view of a preferred embodiment of the invention.
Figure 2:
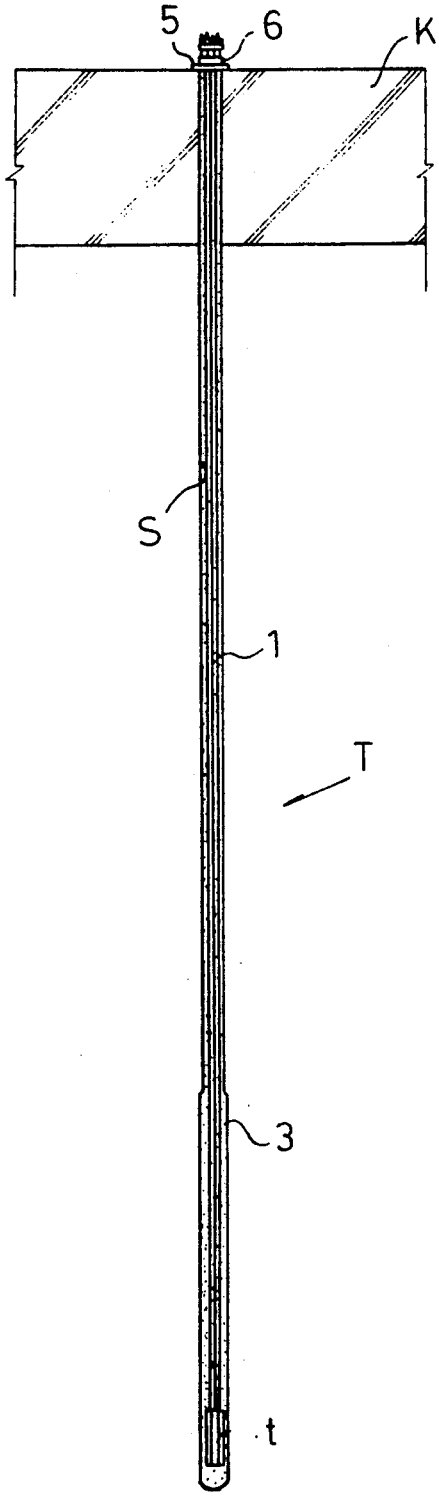
FIG. 2 is a partially sectioned plan view of the preferred embodiment of the invention shown in FIG. 1.
Figure 3:
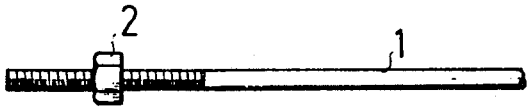
FIG. 3 is a threaded rod tension member comprising an element of one embodiment of the invention.
Figure 4:
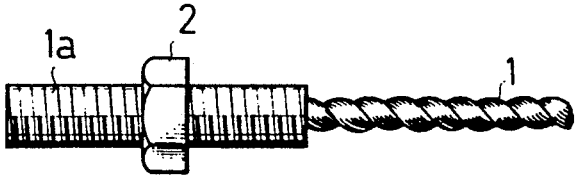
FIG. 4 is a wire rope tension member comprising an element of one embodiment of the invention.
Figure 5:
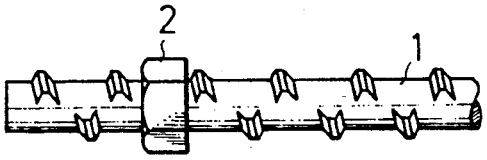
FIG. 5 is a segmented threaded rod tension member comprising an element of one embodiment of the invention.
Figure 6:
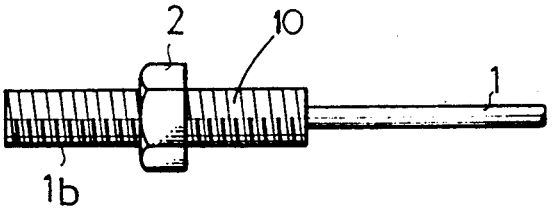
FIG. 6 is a rod embodiment of a tension member with a threaded ferrule secured to one end of the tension member.

FIGS. 1 and 2 show a method according to the present invention for fixing a foundation anchor T embedded in the ground to a concrete foundation wall K in order to reinforce the concrete wall against earth pressure and hydraulic pressure and/or to stabilize the structure itself against floating-up due to the buoyancy of underground water. More particularly, a plurality of tension members 1 comprising elements of the foundation anchor T are individually fixed with nuts 2*a*–2*h* (see also FIGS. 10 and 11) to the concrete structure body K in a novel manner.

As shown in FIGS. 3 through 6, illustrating four preferred embodiments of tension members, tension member 1 has one end provided with a threaded portion and the other end provided with a deadman metal fitting t fixed in grout in the foundation, as shown in FIGS. 1 and 2.

The foundation anchor T is inserted into an excavation hole S bored into the earthen foundation through the concrete structure body K as shown in FIGS. 1 and 2, and embedded therein by fixing the deadman t in a grout material 3, such as mortar, filled in the hole S in such a manner that the foundation anchor T is capable of resisting tensile forces imposed on the tension members 1 by transient pressures against the foundation wall members K. To this purpose, tension members 1 are pre-tensioned by means best shown in FIGS. 9 through 19.

Figure 9:
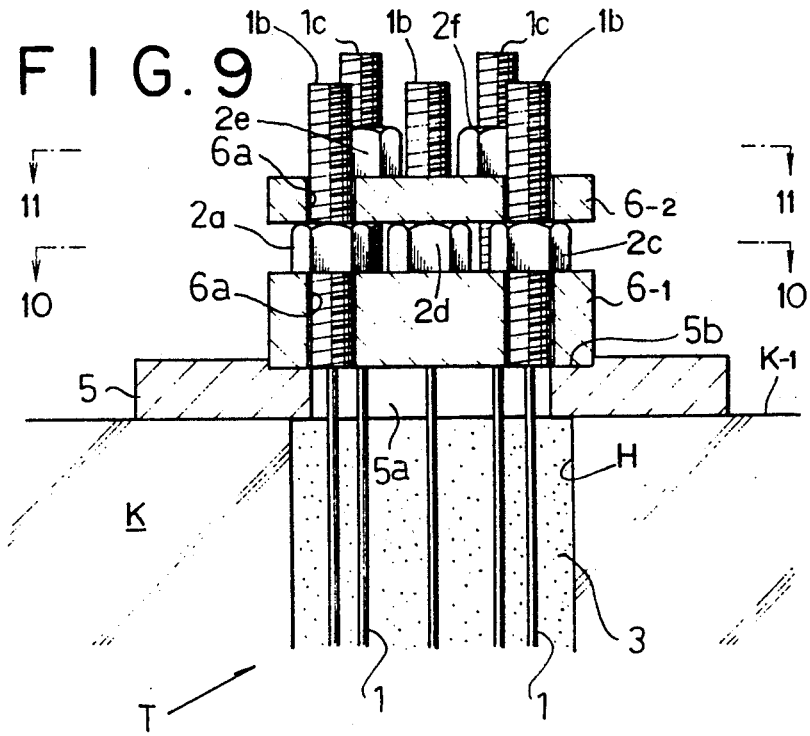
FIG. 9 is a fragmentary elevational view of the invention in partial section showing the tension members of FIG. 6, taken along the line 9—9 of FIG. 10.
Figure 10:
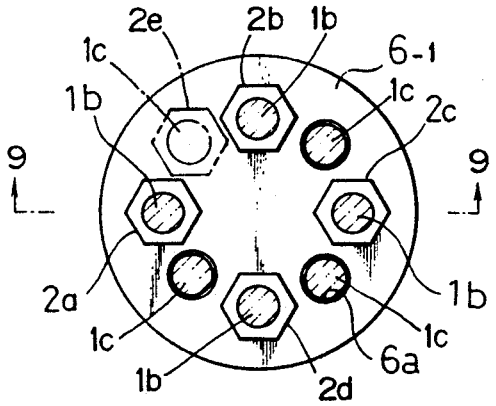
FIG. 10 is a sectional view taken along the line 10—10 of FIG. 9.
Figure 11:
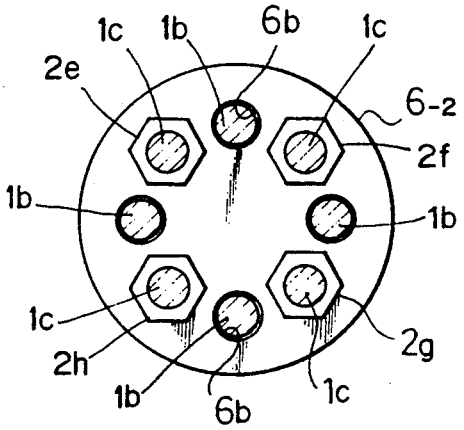
FIG 11 is a sectional view taken along the line 11—11 of FIG. 9.
Figure 12:
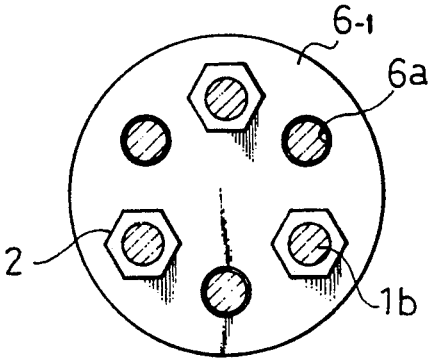
FIG. 12 is a sectional view similar to FIG. 10, but showing fewer members.
Figure 13:
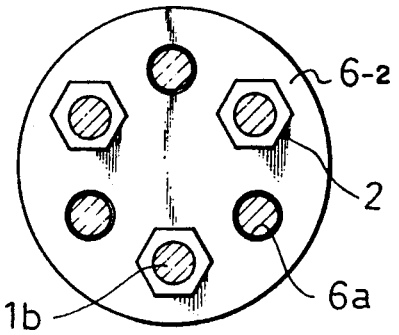
FIG. 13 is a sectional view similar to FIG. 11, but showing fewer members.

Referring now to FIGS. 9 through 11, therein are shown means to pass eight tension members 1 through a hole H of a foundation wall K which by prior art means could only accommodate four tension members for a given size threaded fastener bearing plate similar to anchor plate 6-1, FIG. 9. Although a preferred embodiment of the anchor plate 6-1 is shown as being circular in FIG. 9, the invention is not limited to circular anchor plates. The shape of the anchor plate can be a function of space limitations not a part of the invention, and therefore is not discussed further herein.

The limitation on tension members is determined by the working area of the anchor plate required to thread and to tighten each nut on the threaded ferrule 1*b* secured to the end of each tension member 1. As shown in FIG. 10, four nuts 2*a*, 2*b*, 2*c*, and 2*d*, evenly spaced apart and fastened to ferrules 1*b*, can be accommodated on the upper surface of anchor plate 6-1. Shown in cross-section between nuts 2(*a*–*d*) are four additional tension member ferrules 1*c*. However, additional nuts, such as 2*e*, shown in phantom, cannot be threaded onto ferrules 1*c* because of lack of tool space and interference between nut 2*e* and adjacent nuts 2*a* and 2*b*.

Applicants have solved this problem by axially stacking a second tension member anchor plate 6-2 on and aligned with tension member anchor plate 6-1. As previously stated with respect to anchor plate 6-1, anchor plate 6-2 need not be circular. The tension member anchor plates are each provided with eight ferrule holes which are concentrically aligned, i.e., holes 6*a* in plate 6-1 and holes 6*b* in plate 6-2. By passing all eight ferrules through the holes 6*a* and 6*b* of anchor plates 6-1 and 6-2, respectively, and staggering four nuts, 2*a*, 2*b*, 2*c*, and 2*d*, on anchor plate 6-1, FIG. 10, with four nuts, 2*e*, 2*f*, 2*g*, and 2*h*, on anchor plate 6-2, FIG. 11, eight tension members are secured to the foundation wall within a projected area on the wall no greater than the area of anchor plate 6-1. Obviously, if the eight tension members 1 were to be secured to a single anchor plate, the cross-sectional area of the foundation wall hole would have to be proportionately increased, with a resultant weakening of the wall and increased potential for leaking and cracking.

Figure 7:
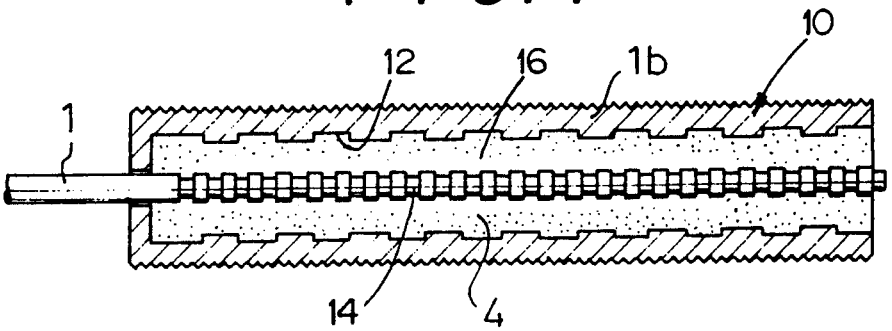
FIG. 7 is an enlarged view in partial section of the tension member shown in FIG. 6.
Figure 8:
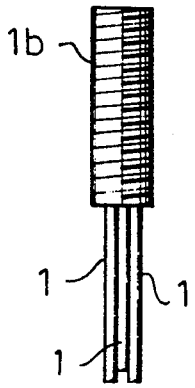
FIG. 8 is a threaded rod embodiment of a tension member similar to FIG. 6 but having two or more rod components.

The method of mounting the inventive foundation anchor is illustrated consecutively in FIGS. 1 and 14 through 19. As shown in FIG. 1, eight tension members 1, such as steel rods, bars, strands, wire rope, or the like, have secured on their lower ends deadman ferrules t set in hardenable grout. On their upper ends, threaded ferrules are secured, preferably of the construction shown in FIGS. 6 and 7. An exteriorly threaded cylindrical ferrule 10, FIG. 7, with an interior grooved wall 12, is fitted over the grooved end 14 of steel rod tension member 1. The annular space 16 between the interior ferrule wall 12 and the grooved end 14 of the tension member is filled with hardenable grout 4 which interlocks with the grooved ferrule wall 12 and the grooved tension member end 14, to securely hold the ferrule 10 on the end of the tension member 1. Referring again to FIG. 1, therein is shown an excavation hole S adjacent to a foundation wall hole H. The deadmen t are positioned at the bottom of the excavation hole S, and the ferrule ends of tension members 1 are passed through foundation hole H.

Figure 16:
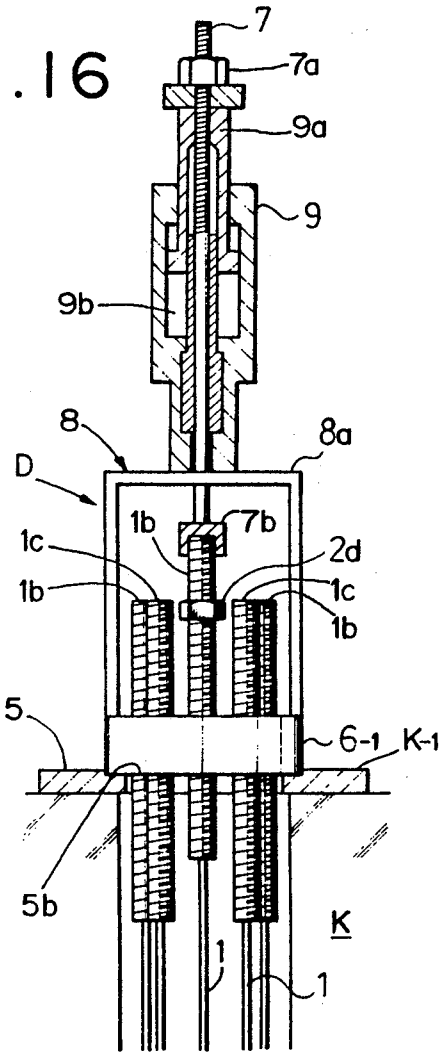
FIG. 16 is a fragmentary elevational view of the invention showing a third step of assembly.
Figure 15:
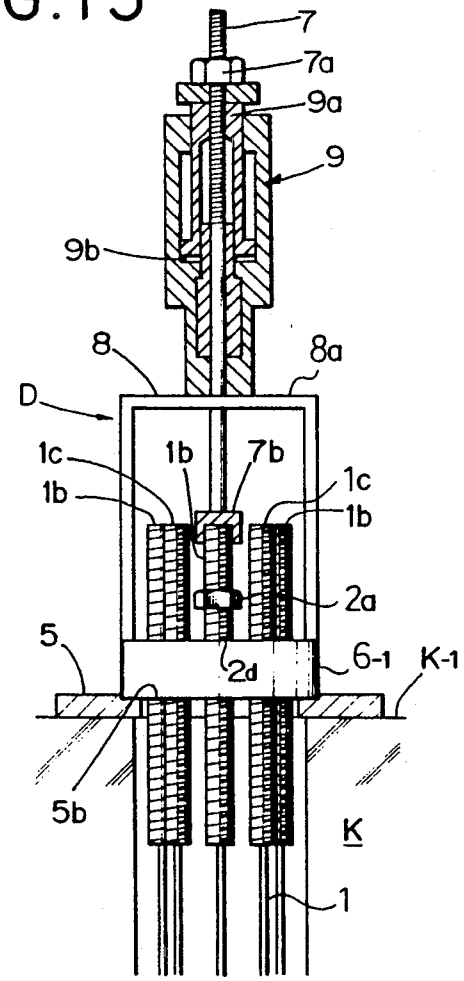
FIG. 15 is a fragmentary elevational view of the invention showing a second step of assembly.
Figure 14:
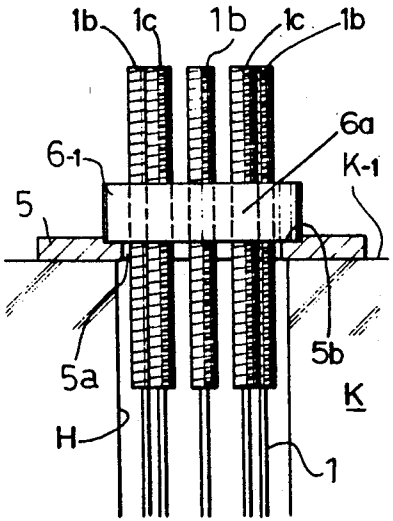
FIG. 14 is a fragmentary elevational view of the invention showing a first step of assembly.
Figure 19:
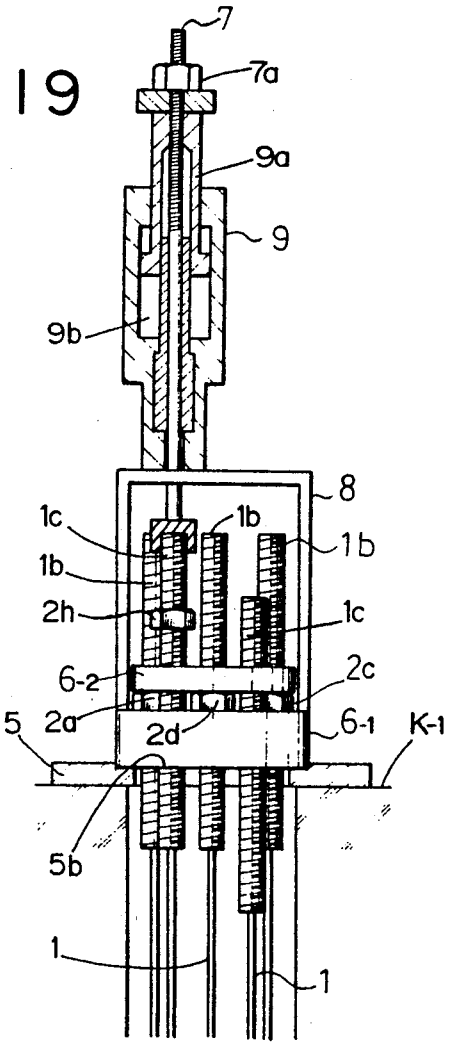
FIG. 19 is a fragmentary elevational view of the invention showing a sixth step of assembly.
Figure 18:
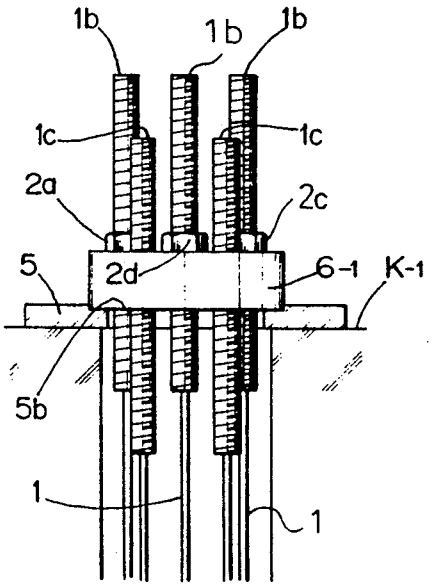
FIG. 18 is a fragmentary elevational view of the invention showing a fifth step of assembly.
Figure 17:
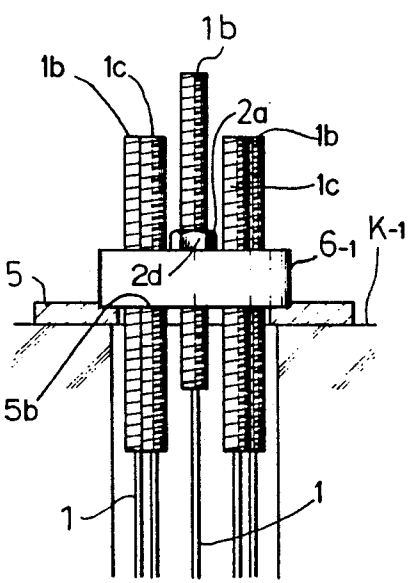
FIG. 17 is a fragmentary elevational view of the invention showing a fourth step of assembly.

Referring now to FIG. 14, therein is shown a foundation bearing plate 5, resting on the inner wall surface K-1 of foundation wall K, having a center opening 5*a* substantially concentric with and slightly overlapping the foundation hole H. Tension member anchor plate 6-1 is mounted on bearing plate 5 in recess 5*b*, and all eight ferrules are passed through holes 6*a*, as shown in FIG. 10. As shown in FIG. 15, in a preferred embodiment of the invention, a tension member tensioning device D, comprising a reaction frame 8, a tension rod 7, and a hydraulic jack 9, is placed over ferrule groups 1*b* and 1*c*, and is rested on the upper face of anchor plate 6-1. A nut 2*d* is threaded on a first ferrule 1*b*, followed by a threaded cap 7*b* of tensioning rod 7, which threadedly engages the top of the first ferrule 1*b*. A hydraulic jack 9 is next fitted over tensioning rod 7 to rest on the top surface 8*a* of reaction frame 8. A nut 7*a* is threaded onto tensioning rod 7 to engage the top surface of piston 9*a*. Hydraulic pressure is admitted into chamber 9*b* to lift piston 9*a* which applies pressure to the underside of nut 7*a* to stress tensioning member 1, capped with a 1*b* ferrule, as shown in FIG. 16. When 1*b* ferrule-capped tension member 1 has been fully stressed, nut 2*d* is threaded into pressure engagement with the top surface of anchor plate 6-1 to hold the tension in the first 1*b* ferrule-capped tension member. See FIG. 17. This sequence of operations is then repeated for the other three 1*b* ferrule-capped tension members, as shown in FIG. 18, wherein nuts 2*a*, 2*b*, and 2*c* are also threaded into pressure engagement with the top surface of anchor plate 6-1.

After tension members 1 with 1*b* ferrules have been secured to anchor plate 6-1 and tensioned, a second anchor plate 6-2 is fitted over all eight ferrules. The four 1*c* ferrule-capped tension members are then sequentially tensioned with tensioning device D in the same manner as the 1*b* ferrule-capped tension members 1, just described. Following tensioning of the 1*c* ferrule-capped tension members, nuts 2*e*, 2*f*, 2*g*, and 2*h* are placed in pressure engagement with the top surface of anchor plate 6-2, as shown in FIG. 9. The undersurface of anchor plate 6-2 engages the top surfaces of nuts 2*a*, 2*b*, 2*c*, and 2*d*, which are then sandwiched between anchor plates 6-1 and 6-2 under pressure. Tensioning device D is then disconnected and removed from the anchor plate 6-2 to be reused at other locations on the foundation wall to secure yet as many other foundation anchors as may be required.

It is contemplated that any form of tensioning device may be used in the practice of the inventive method, including a mechanical jack.

In another embodiment of the invention it is contemplated that tensioning devices such as mechanical and hydraulic jacks may be dispensed with, and that necessary tensioning will be obtained by tightening nuts 2*a*–2*d* into pressure contact with the upper surface of anchor plate 6-1, and by tightening nuts 2 (*e*–*h*) into pressure contact with the upper surface of anchor plate 6-2.

While several embodiments of the invention have been disclosed, it will be appreciated that, from a study of the disclosure, other numbers and combinations of threaded tension members and other tensioning means may be used in conjunction with other geometrical hole patterns in the receiving plates. Such modifications will occur to those skilled in the art without departing from the spirit and scope of the invention as defined in the appended claims.

What is claimed is:

1. A method for securing a foundation anchor to the foundation of a structure, wherein the foundation anchor comprises a plurality of elongated tension members, each of which has a free end and a fixed end, said fixed ends being secured in hardened grout embedded in foundation supporting earth, said free ends having threads formed thereon and being of sufficient length to extend through a foundation anchor hole and to be secured on one side of the foundation, comprising the steps of:

(a) providing a first anchor plate of predetermined size, having upper and lower faces, and having holes therethrough matching in number said plurality of elongated tension members;

(b) placing and centering said first anchor plate over a rim of said foundation anchor hole;

(c) inserting said threaded free ends of said tension members through said holes in said first anchor plate;

(d) threading first nuts onto said threaded free ends of a first group of tension members until pressure bearing contact is made between said first nuts and the said upper face of said first anchor plate;

(e) continuing to thread said first nuts in pressure bearing contact with said upper face of said first anchor plate until said first group of tension members are tensioned;

(f) providing a second anchor plate having upper and lower faces and having substantially the same dimensions as said first anchor plate, said second anchor plate having holes therethrough in equal number and diameter and alignable with said holes in said first anchor plate, and said second anchor plate having upper and lower faces;

(g) aligning said second anchor plate over said first anchor plate;

(h) concentrically aligning said holes in said second anchor plate with said holes in said first anchor plate;

(i) inserting said threaded free ends of said tension members through said holes in said second anchor plate;

(j) placing the said lower face of said second anchor plate in pressure bearing contact with said first nuts previously threaded into pressure bearing contact with said upper face of said first anchor plate;

(k) threading second nuts onto the threaded free ends of a second group of tension members until pressure bearing contact is made between said second nuts and the said upper face of said second anchor plate; and (l) continuing to thread said second nuts into pressure bearing contact with said upper face of said second anchor plate until said second group of tension members are tensioned.

2. The method of claim 1, further comprising the step of positioning a bearing plate between said foundation and said first anchor plate.

3. The method of claim 1, further comprising the steps of:

(m) sequentially fastening said threaded free ends of said first group of tension members with tension increasing means following the previous step of threading first nuts onto said threaded free ends of said first group of tension members;

(n) applying tension to said first group of tension members with said tension increasing means;

(o) retaining said applied tension to said first group of tension members by further threading said first nuts into pressure bearing contact with said upper face of said first anchor plate;

(p) sequentially fastening said threaded free ends of said second group of tension members with said tension increasing means following the step of threading said second nuts onto said threaded free ends of said second group of tension members;

(q) applying tension to said second group of tension members; and (r) retaining said applied tension to said second group of tension members by further threading said second nuts into pressure bearing contact with said upper face of said second anchor plate.

4. The method of claim 3, further comprising the step of positioning a bearing plate between said foundation and said first anchor plate.

5. The method of claim 1, further comprising the steps of:

(m) securing threaded sleeves over the said free ends of said tension members prior to inserting said free ends through said holes in said first anchor plate;

(n) inserting said threaded sleeves through the holes in said first anchor plate;

(o) threading said first nuts onto the threaded sleeves of said first group of said tension members into pressure engagement with said upper face of said first anchor plate;

(p) further tensioning said first group of tension members;

(q) inserting said threaded sleeves through the holes in said second anchor plate;

(r) threading said second nuts onto the threaded sleeves of said second group of said tension members into pressure engagement with said upper face of second anchor plate; and (s) further tensioning said second group of tension members.

6. The method of claim 5, further comprising the step of positioning a bearing plate between said foundation and said first anchor plate.

7. The method of claim 5, wherein said threaded sleeves each comprise a threaded exterior cylindrical surface and a grooved interior cylindrical surface; said free ends of said tension members each being grooved, positioned within, and radially spaced from said sleeve interior cylindrical surface, further comprising the step of packing hardenable grout in each of said sleeves to fill the space between said interior cylindrical surface of each said threaded sleeve and the grooved ends of each of said free ends of each of said tension members to secure each of said grooved free ends of said tension members radially spaced from each of said sleeve interior cylindrical surfaces; and the step of permitting said grout to harden before the step of tensioning said first group of tension members.

* * * * *